United States Patent [19]

Foures

[11] Patent Number: 4,691,842

[45] Date of Patent: Sep. 8, 1987

[54] PROCESS APPARATUS AND SYSTEM FOR PRESERVING AND DISPENSING WINE

[76] Inventor: Jacques Foures, Domaine de la Meunière Cenac, 33360 La Tresne, France

[21] Appl. No.: 712,924

[22] Filed: Mar. 18, 1985

Related U.S. Application Data

[63] Continuation of Ser. No. 209,141, Nov. 21, 1980, abandoned.

[51] Int. Cl.[4] ..... B67D 1/04

[52] U.S. Cl. ..... 222/1; 222/146.1; 222/146.6; 222/152; 222/397; 222/400.7

[58] Field of Search ..... 222/146.1, 1446.6, 152, 222/400.7, 1, 397, 394, 399; 165/26, 61

[56] References Cited

U.S. PATENT DOCUMENTS

| | | | |
|---|---|---|---|
| 1,648,575 | 11/1927 | Campbell | 222/397 |
| 2,018,543 | 10/1935 | Buirk | 222/397 X |
| 2,092,105 | 9/1937 | Brunner | 165/61 |
| 2,164,730 | 7/1939 | Bäckström | 165/26 X |
| 2,489,049 | 11/1949 | Root | 165/26 X |
| 2,929,535 | 3/1960 | Fairbanks | 222/397 X |
| 3,195,779 | 7/1965 | Nicko | 222/146 C X |
| 3,211,214 | 10/1965 | Chambers | 62/3 X |
| 3,428,218 | 2/1969 | Cova | 222/400.7 X |
| 3,883,043 | 5/1975 | Lane | 222/152 X |
| 3,943,727 | 3/1976 | Wade | 165/30 X |
| 4,008,832 | 2/1977 | Routh | 222/146.6 X |
| 4,011,971 | 3/1977 | Haydon | 222/399 |
| 4,308,975 | 1/1982 | Bowen | 222/146 C X |
| 4,355,735 | 10/1982 | Whorton et al. | 222/397 X |
| 4,392,578 | 7/1983 | Fipp et al. | 222/152 X |
| 4,440,318 | 4/1984 | Berger | 222/397 X |

FOREIGN PATENT DOCUMENTS

| | | | |
|---|---|---|---|
| 509581 | 2/1955 | Canada | 222/397 |
| 229300 | 12/1910 | Fed. Rep. of Germany . | |
| 962502 | 4/1987 | Fed. Rep. of Germany | 222/146 R |
| 352848 | 8/1905 | France . | |
| 354225 | 10/1905 | France . | |
| 1478997 | 3/1967 | France . | |

*Primary Examiner*—Joseph J. Rolla
*Assistant Examiner*—Frederick R. Handren
*Attorney, Agent, or Firm*—Sandler & Greenblum

[57] ABSTRACT

A process, apparatus, and system are provided for preserving and dispensing wine from a bottle or other container. The process involves directing a chemically inert gas under pressure from a reservoir to a bottle containing a wine. The pressure of the gas is reduced prior to its introduction into the bottle. The bottle is positioned generally vertically within a hermetically and thermally sealed enclosure. A gas flow line enters the bottle and has a first end connected to a gas source and a second end which terminates within the bottle between a bottle plug and the contained liquid. By passing the gas into the bottle, liquid within the bottle is forced through an end of a second line which is positioned in the wine to a second end of the line positioned on the exterior of the bottle. The flow of wine is caused by the introduction of gas under pressure into the interior of the bottle between the bottle plug and the wine. The apparatus for performing the process includes first and second flow lines, a gas reservoir, a gas valve and spigot and a wine spigot. The system includes the same elements and further includes a vertically upstanding bottle, a bottle closure and a hermetically and thermally sealed enclosure in which the bottle is positioned.

3 Claims, 1 Drawing Figure

PROCESS APPARATUS AND SYSTEM FOR PRESERVING AND DISPENSING WINE

This application is a continuation of application Ser. No. 209,141, filed Nov. 21, 1980, now abandoned.

BACKGROUND OF THE INVENTION

1. Field of the Invention

The present invention relates to a process for the preservation and distribution of wine contained in a bottle and an installation adapted for use with the process.

2. Discussion of Prior Art

It is conventional to prevent oxidation of wine upon contact with air contained in partially filled closed storage containers, by the utilization of a chemically inert gas such as nitrogen. Such gas is introduced into the upper portion of such containers in a quantity sufficient to compensate for or fill the void or empty space in the containers and so as to purge the air contained in the space. This mode of preservation is perfect but does not serve to distribute the wine. Distribution or dispensing of wine is caused by means of valves placed at the lower portion of the containers and by the weight of the wine, the nitrogen being introduced into the void space in the upper position of the container during the course of flow of the wine.

SUMMARY OF THE INVENTION

The preservation and distribution process of white wines, red wines, roses, etc., contained in a bottle, and the installation and system which carry out the process, in accordance with the present invention, consist in the introduction of a chemically inert gas the selection of which depends upon the category and nature of the wine, e.g., nitrogen, carbon dioxide or a mixture of the two gases, contained under pressure in one or more storage reservoirs. The gas or gases are brought across via a first line at a pressure regulated by a pressure reducing valve, to the interior of the bottle, which is maintained vertically in a hermetically and thermally sealed enclosure. The gas or gases are introduced between the neck of the container/bottle and the liquid contained in the said bottle so as to fill any void in the container and to thereby prevent the penetration of air into the void. The gas inlet line passes across the bottle mouth and terminates generally flush therewith within the interior of the bottle. The pressure of the gas on the interior of the bottle is determined by a manual adjustment valve and can be varied in accordance with the category of wines being preserved. In this fashion a necessary pressure will be exerted to allow for the flow of wine across a second line crossing through the bottle plug. The second line has an end extending into the liquid contained in the bottle and terminating before reaching the bottle thereof, the other end of the second line being provided with a stop valve.

BRIEF DESCRIPTION OF THE DRAWINGS

Other characteristics and advantages of the invention will become more clear from the description which will follow made by way of reference to the annexed schematic FIGURE, which is given as a non-limiting example used in the process.

DETAILED DESCRIPTION OF THE DRAWINGS

Figure 1:
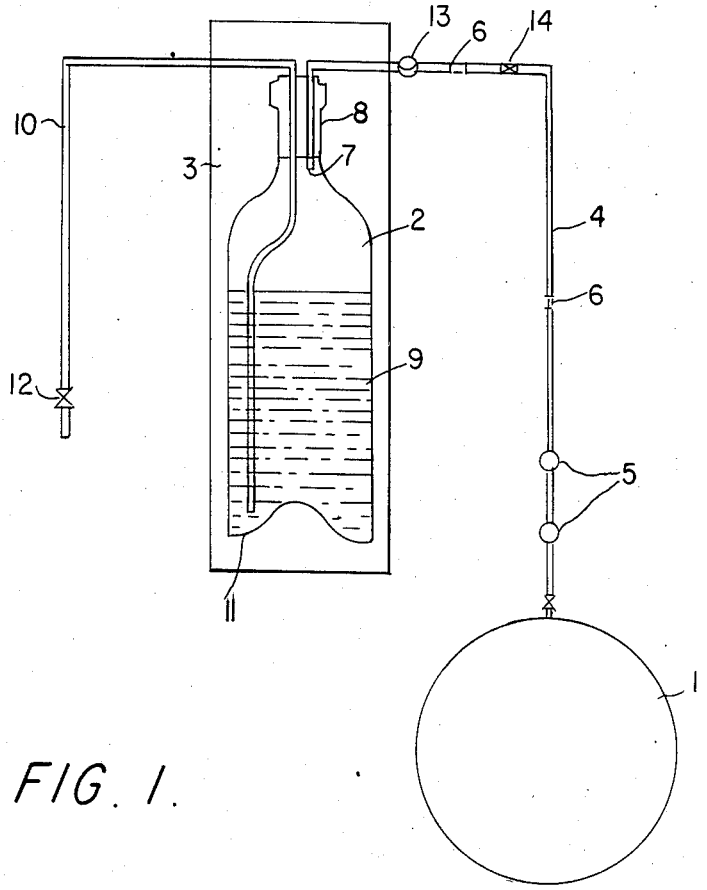

As shown, the installation comprises one or more storage reservoirs 1 of compressed gas, e.g., nitrogen, carbon dioxide or mixtures of the two gases. The gas is chemically inert and is chosen depending upon the nature of the wine 9 to be preserved or to be extracted. The wine is contained in a bottle 2 positioned vertically in a hermetically and thermally sealed enclosure 3. The enclosure is provided with an evaporator, a resistance heater and with a precise probe (not shown), such that the wine contained in the bottle, dependent on its nature, is maintained at a constant temperature corresponding to the temperature at which the wine must be served and/or tasted. The compressed gas in the reservoir or reservoirs 1 is directed towards the enclosure 3 by means of a first line 4 provided with one or more pressure reducing valves 5 for adjusting the pressure of the gas or gases along the interior of line 4, and with one or more valves 6 which are provided to prevent surges or blasts in pressure. The end of 7 first line 4, which is opposite to the reservoir or reservoirs 1 located in the interior of the enclosure 3, traverses the bottle plug 8, which closes bottle 2 containing the wine. The bottom end 7 of line 4 terminates generally flush with the end of the plug 8 on the interior of the bottle 2 such that the gas or gases from reservoir(s) 1 are diffused in the bottle 2 in the empty or void space between wine 9 contained in the bottle and the plug 8. In this manner, no penetration of air into this space is possible, which air is disadvantageous to the preservation of the wine.

To extract the wine 9 contained in the bottle 2, a second line 10 is provided, it also penetrating into bottle 2 via bottle plug 8 and then extending into wine 9. Line 10 terminates before the bottom 11 of the bottle 2 so as to space one end of line 10 from possible wine deposits at the bottom of the bottle. The extraction of wine 9 through the line 10 is caused by pressure from the gas or gases introduced into the void space above the wine in the bottle 2, thereby causing a liquid flow which can be interrupted or controlled by a spigot 12 placed at the other end of the line 10. Depending on the nature of the wine and the time when the flow must be interrupted so that the wine contained will not deteriorate due to possible exchanges between gas and wine, and so as to maintain the bouquet caused by aging, the gas pressure in the bottle will either permit the flow of the wine or be diminished or reduced to nil by means of manually variable adjustment valve 13. Gas introduction is interruptable by or controllable by spigot 14 which is positioned along line 4 upstream of valve 13.

I claim:

1. A method for preserving and dispensing wine from a bottle partially filled with said wine, said method comprising:

(a) providing an apparatus for preserving and dispensing wine including:

(i) a hermetically and thermally sealed enclosure for said wine bottle;

(ii) at least one reservoir adapted to contain said inert gas;

(iii) a first line for gas flow having one end connected to said reservoir and a second end terminating within said wine bottle adjacent to said plug, said second end being located between said plug and said wine;

(iv) at least one pressure reducing valve positioned along said first line adjacent said reservoir;

(v) at least one valve located in said first line downstream of said pressure reducing valve for preventing surges or blasts of pressure within said first line;

(vi) a second line for liquid flow having one end positioned within said wine bottle adjacent the bottom of said wine bottle and within said wine and a second end located outside said wine bottle and enclosure;

(vii) a spigot for controlling the flow of wine through said second line wherein said gas under pressure is compressed gas and wherein the low pressure gas introduced into said void space is sufficient to force said wine into said second line; and (viii) means including a manually variable adjustment valve in communication with said wine bottle for venting said gas from said bottle so as to minimize the exposure of said wine to said gas, and for controlling the pressure in the void space within the bottle, so as to control the flow or non-flow and diminish the flow of wine;

(b) directing a compressed inert gas via said first line from said reservoir into said wine bottle;

(c) conducting said wine from said one end of said second line through said second line and outwardly from said wine bottle towards said second end of said second line so as to dispense wine from said wine bottle; and (d) operating said manually variable adjustment valve to vent said gas from said wine bottle during periods of storage of said wine bottle in said enclosure between periods of dispensing so as to minimize exposure of wine to said gas.

2. A method of preserving and dispensing wine from a wine container partially filled with said wine, said method comprising:

(a) providing an apparatus for preserving and dispensing wine including:

(i) an hermetically and thermally sealed enclosure for said wine container;

(ii) at least one container for wine having a top closure and defining a void space within said container, said wine container being located within said enclosure;

(iii) at least one gas line having one end and another end, said one end terminating within said wine container adjacent to said closure;

(iv) at least one reservoir for storing gas under pressure in communication with said another end of the gas line for supplying said gas to said container thereby subjecting wine within the container to pressure;

(v) a means for regulating a supply of said gas from said reservoir through said gas line, said means for regulating being located in said gas line;

(vi) a liquid line for dispensing wine having one end located outside said container and another end terminating adjacent the bottom within said container to permit pressurized wine to flow out from said container through said liquid line for dispensing;

(vii) means for opening and closing said liquid line for dispensing wine so as to interrupt the passage of pressurized liquid through said liquid line for dispensing; and (viii) means for variably adjusting the pressure to which wine within the container is subjected in communication with said container, said means for variably adjusting including a valve for venting said gas so as to reduce or eliminate the gas from said container and thereby diminish the flow and control the flow and non-flow of wine through said liquid line for dispensing:

(b) directing a compressed inert gas via said gas line from said reservoir into said wine bottle;

(c) connecting said wine from said one end of said liquid line through said liquid line and outwardly from said wine bottle towards said second end of said liquid line so as to dispense wine from said wine bottle; and (d) manually operating said valve to vent said gas from said wine bottle during periods of storage of said wine bottle in said enclosure between periods of dispensing so as to minimize exposure of wine to said gas.

3. A method of preserving and dispensing wine from a container partially filled with said wine, said method comprising:

(a) providing an apparatus for preserving and dispensing wine including:

(i) an hermetically and thermally sealed enclosure;

(ii) at least one container for wine having a top closure and defining a void space within said container, said container being located within said enclosure;

(iii) at least one gas line having one end and another end, said one end terminating within said container adjacent to said closure;

(iv) at least one pressure reducing valve located in said at least one gas line towards said another end;

(v) at least one valve located downstream from said pressure reducing valve for preventing surges or blasts of pressure within said gas line;

(vi) at least one reservoir for storing gas under pressure in communication with said another end of the gas line for supplying said gas to said container thereby subjecting liquid within the container to pressure;

(vii) means for regulating a supply of gas from said reservoir through said gas line, said means for regulating being located in said gas line;

(viii) a liquid line for dispensing wine having one end located outside said container and another end terminating adjacent the bottom within said container to permit pressurized wine to flow out from said container through said liquid line for dispensing.

(ix) means for opening and closing said liquid line for dispensing wine so as to interrupt the passage of pressurized liquid through said liquid line for dispensing; and (x) means for variably adjusting the pressure to which the wine within the container is subjected in communication with said container, said means for variably adjusting including a valve for venting said gas so as to reduce or eliminate the gas from said container and thereby diminish the flow and control the flow and non-flow of liquid through said liquid line for dispensing and to minimize the exposure of said wine to said gas during periods of time between dispensing operations;

(b) directing a compressed inert gas via said gas line from said reservoir into said container;

(c) conducting said wine from said one end of said liquid line through said liquid line and outwardly from said container towards said second end of said liquid line; and (d) manually operating said valve to vent said gas from said wine bottle during periods of time the wine bottle remains within said enclosure between periods of dispensing so as to minimize exposure of wine to said gas.

* * * * *